United States Patent [19]

Funke

[11] Patent Number: 4,905,625

[45] Date of Patent: Mar. 6, 1990

[54] APPARATUS FOR WAXING SKIS

[75] Inventor: Eberhard Funke, D-Teningen, Fed. Rep. of Germany

[73] Assignee: Wax Boy SA, Chene-Bourgeries, Switzerland

[21] Appl. No.: 206,287

[22] Filed: Jun. 14, 1988

[30] Foreign Application Priority Data

Dec. 4, 1987 [EP] European Pat. Off. ..... 87810721.8

[51] Int. Cl.[4] ..... B05C 1/02

[52] U.S. Cl. ..... 118/58; 118/72; 118/200; 118/209; 118/244; 118/258; 118/600

[58] Field of Search ..... 118/72, 200, 202, 239, 118/244, 258, 110, 58, 600, 13, 19, 209, 62, 63, 66, 100, 101, 103; 427/428

[56] References Cited

U.S. PATENT DOCUMENTS

| | | | |
|---|---|---|---|
| 1,979,436 | 11/1934 | Bedford | 118/13 |
| 2,537,511 | 1/1951 | Coulombe | 118/72 |
| 3,136,659 | 6/1964 | Walker et al. | 118/202 |
| 3,425,394 | 2/1969 | Rey | 118/72 |
| 4,029,046 | 6/1977 | Hertel | 118/202 |
| 4,182,786 | 1/1980 | Hertel | 427/428 |
| 4,407,218 | 10/1983 | Ordas | 118/258 |
| 4,457,255 | 7/1984 | Amann | 118/244 |
| 4,577,586 | 3/1986 | Morris et al. | 118/63 |

FOREIGN PATENT DOCUMENTS

| | | | |
|---|---|---|---|
| 128411 | 3/1932 | Austria | 118/72 |
| 1478167 | 3/1970 | Fed. Rep. of Germany . | |
| 1578879 | 10/1971 | Fed. Rep. of Germany . | |
| 8004959 | 2/1980 | Fed. Rep. of Germany . | |
| 8101204 | 1/1981 | Fed. Rep. of Germany . | |
| 8333535 | 3/1985 | Fed. Rep. of Germany . | |
| 8613727 | 11/1986 | Fed. Rep. of Germany . | |
| 548510 | 9/1956 | Italy | 118/72 |

*Primary Examiner*—Willard Hoag

*Attorney, Agent, or Firm*—Marks Murase & White

[57] ABSTRACT

An apparatus for waxing skis, where the skiing person glides through the apparatus with his skis on, comprises transport rolls, a warm air unit for drying and pre-heating the skis, and a waxing unit with a wax roll, 4/5 to 9/10 thereof being immersed into a wax container. The wax in the container is heated by a heating plate extending under the bottom of the wax container and having underneath an insulating layer. The apparatus further comprises a scraping unit with spring mounted scraping knives. For improving the finish of the gliding surface of the skis there is mounted a driven brushing unit, arranged after the scraping knives viewed in the moving direction, and comprising a pair of brushes mounted in pivoted levers and being forced against at least one tension spring, which is fixed to said pivoted lever and at the other end to an adjustable support. The apparatus is coin operated.

9 Claims, 3 Drawing Sheets

APPARATUS FOR WAXING SKIS

The present invention refers to an apparatus for waxing skis, where the skiing person glides through the apparatus with his skis on, comprising transport rolls, a warm air unit for drying and pre-heating the skis, a waxing unit with a wax roll reaching into a wax container having means for heating the wax, and a scraping unit with spring mounted scraping knives for scraping off the wax.

Such an apparatus is known from the DE-U-No. 86 13 727, (Nov. 27, 1986) which has been constructed by the applicant of the present application and tested as prototype for a fabrication in series. Whilst testing it became apparent that several parts and items of the apparatus need improvement. Thus the heating system and the arrangement of the wax roll in the wax box did not work well in extreme cold, and it was found that the finish of the skis after known treatment should be improved.

It is therefore one object of the present invention to avoid the mentioned drawbacks and to improve operation in extreme cold and another object to improve the finish of the waxed skis. These objects are attained with the apparatus according to the claims.

BRIEF DESCRIPTION OF THE DRAWINGS

The invention is described in more detail with reference to the attached drawing as follows

FIG. 1 shows the essential parts of the ski waxing apparatus, whereby the direction of movement of the skis from the left to the right is indicated by an arrow M. The apparatus is conceived as a self contained, rigidly constructed and transportable unit, as will be explained below. The body 1, as shown in FIG. 2, has a length of about twice the length of a ski and comprises several, for instance eight, transport rolls 2 and 39 provided with a layer 3 for increasing the adherence, for example, of rubber.

Figure 1:
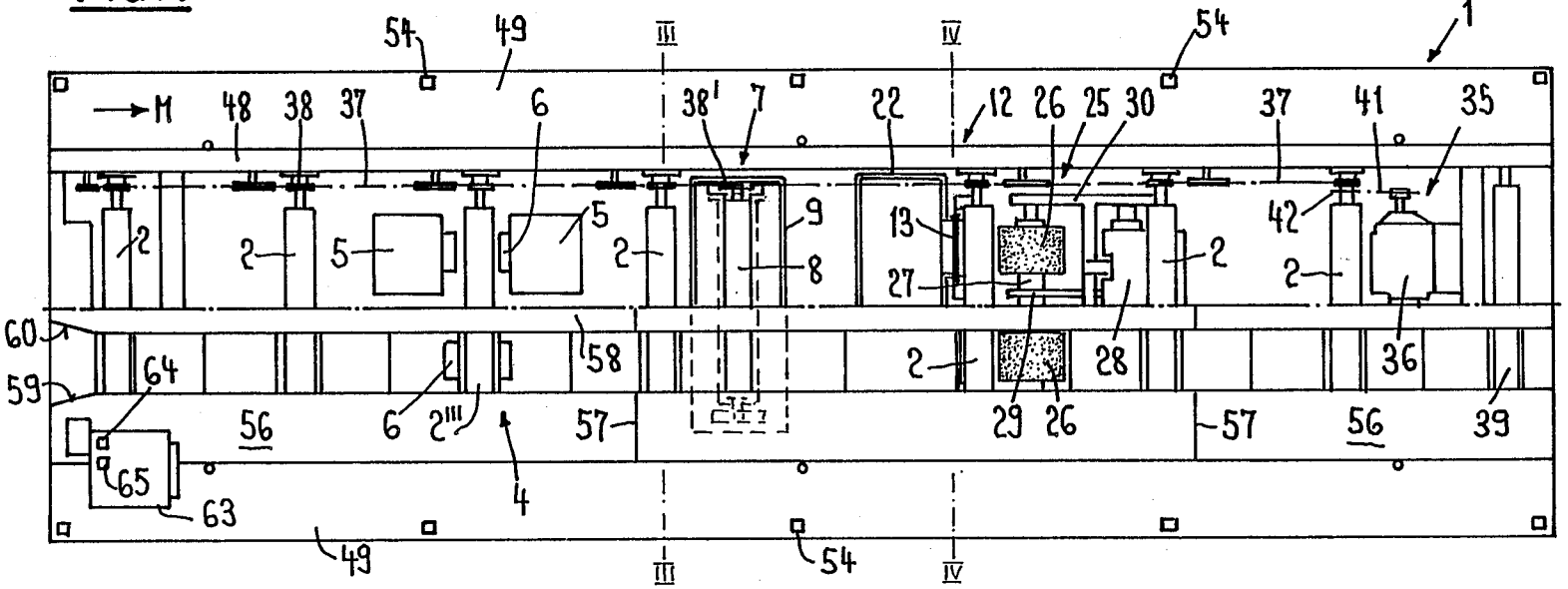
FIG. 1 is a top plane view, with parts cut away, of a preferred embodiment of apparatus for waxing skis according to the present invention.

The first station is a warm air unit 4 for drying and pre-heating the skis. The warm air unit 4 consists of for example four warm air blowers 5 each having a nozzle 6 for blowing warm air onto the gliding surface of the skis. It is also possible to use a pair of blowers with two nozzles each or one central, more powerful blower with connecting pipes and four nozzles. It is further not necessary to use two nozzles for each ski, arranged on both sides of a transport roll 2''', as one appropriately dimensioned nozzle for each ski can serve as well.

The next station is the waxing unit 7, comprising a wax application roll 8, a wax containing box 9 and a heating unit 10 for heating the wax. The wax application roll 8 is a full metal roll of a good heat conducting and heat storing material, such as steel.

The wax roll 8 has a greater diameter than the transport rolls and the level of its highest point is higher than the level of the transport rolls for assuring a good contact between the wax roll and the gliding surface of the skis. An alternative is to mount the axle of the wax roll on a spring suspension with an appropriately designed chain drive mechanism.

Figure 2:
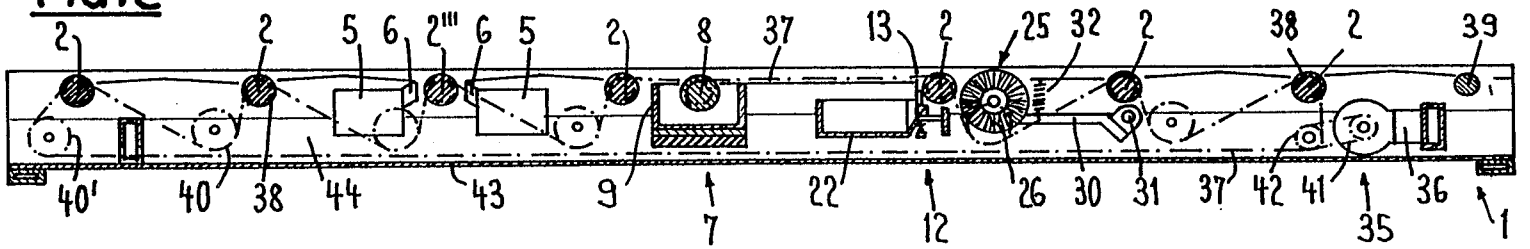
FIG. 2 is a longitudinal sectional view of the apparatus of FIG. 1.

The wax container 9 is relatively large for the same reason as employing a full metal wax roll, that is in order to have a relatively large mass which offers a great heat storage capacity and thus a better constant temperature of the wax. Field studies at low temperature showed that coil heating is not sufficient and in particular, that it creates marked temperature differences within the container, which must be avoided. Therefore, the present wax container is heated with a heating plate 10, which has a temperature insulated bottom 11. The achievement of a potentially constant temperature is enhanced by immersing as much as possible of the wax roll into the wax container, as shown in FIG. 2. This results first in that the heated mass of metal roll and wax is relatively high and inert and second that the overlying mass of solidified wax is small. Thus, when the apparatus is set to work after a while, few turns of the wax roll are enough to produce a uniform layer of warm wax on its surface. The wax container comprises further a not shown thermostat for maintaining the wax at a temperature of for example 120° C., said thermostat being connected to the electrical heating circuit, also not shown. Said circuit can control the motor driving the rolls so that it can only be started if a temperature in the wax container is reached at which the wax is liquid and the wax roll can be driven.

Figure 7:
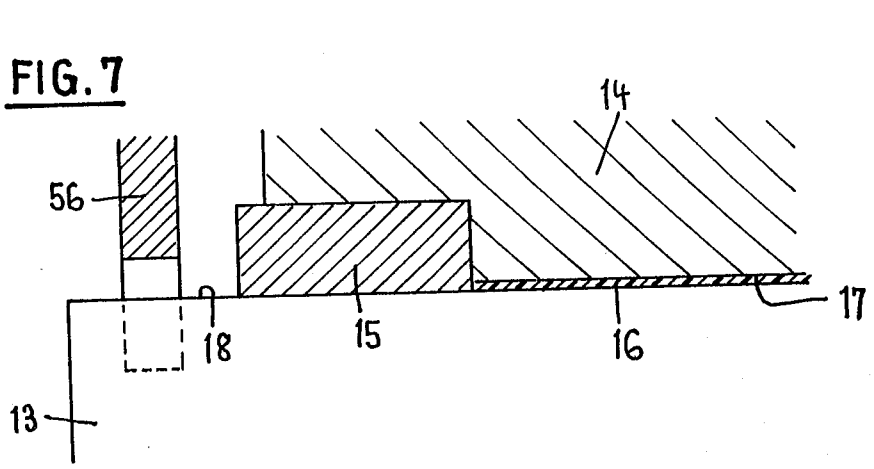
FIG. 7 is an enlarged detail view of a ski being waxed in accordance with the present invention.

The next station is the scraping unit 12, comprising two scraping knives 13 mounted on spring suspension. The level of the knives edges 18 is above the level of the transport and wax rolls for exerting a great enough force to scrape the solidifying wax away, as shown in FIG. 7. This grossly enlarged figure shows a ski 14 with its edge 15 and the wax layer 16, which layer is in line with the surface of the edge of the ski, which depresses the surface 17 of the ski by some small amount, depending largely on the age, i.e. use of the ski. Thus an even surface of the wax layer 16 is attained.

Figure 4:
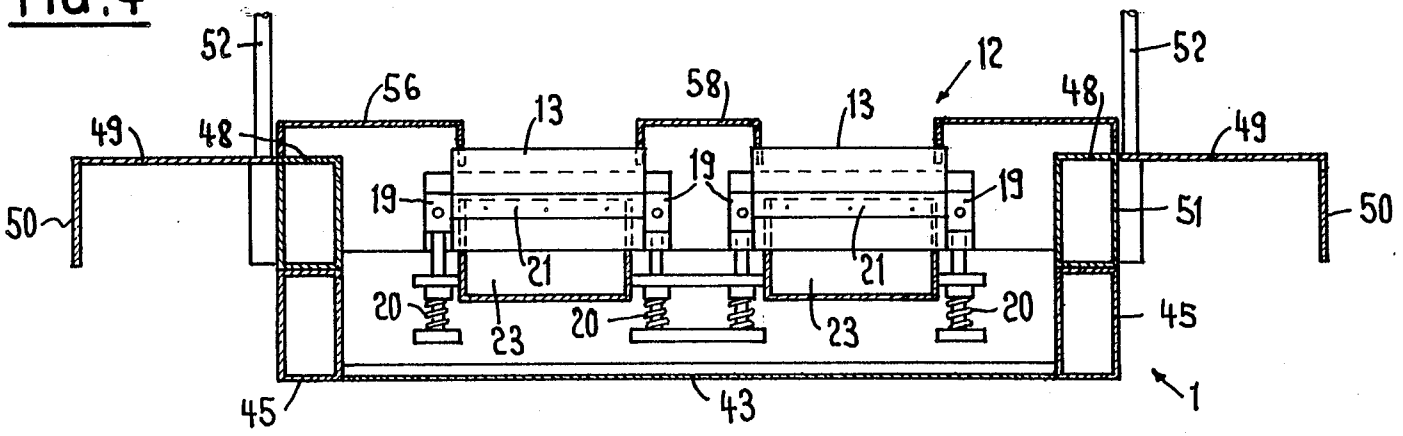
FIG. 4 is a sectional view of the apparatus FIG. 1 taken along line IV—IV in FIG. 1.

As best shown in FIG. 4, each scraping knife is mounted in a pair of supports 19. Each support comprises a storing pressure spring 20, and the two knives are mounted thus as to be independently movable up and down. The supports further comprise a holder 21 for each knife, allowing to change the used knives, usually made of stainless steel.

Figure 5:
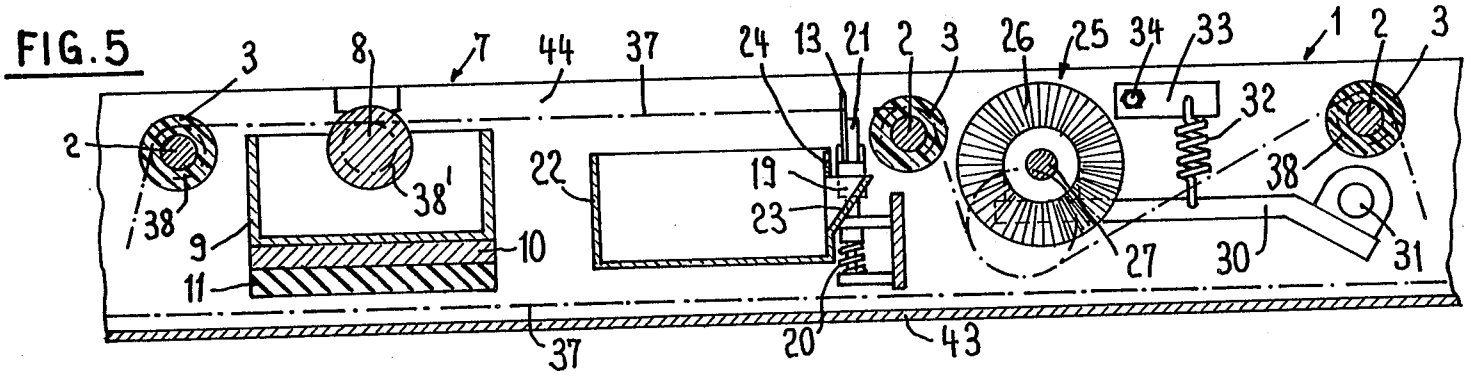
FIG. 5 is a sectional view in greater scale, of a detail of the apparatus of FIG. 2.

It follows from FIG. 5 that the scraped off parts of wax fall into a waste container 22, arranged between the wax roll 8 and the knives, a part 23 of the wall 24 looking toward the knives being louvred to reach behind the knives for collecting all scrapes of wax. The waste container may be heated for forming a wax plate for being recycled into the wax container 9.

The wax layer is subsequently smoothed by the brushing unit 25, following closely the scraping unit 12. The brushing unit 25 comprises two adapted brushes 26, mounted also on spring suspension and is driven independently from the rolls. FIG. 1 shows the brushes 26 mounted rotatably on a common shaft 27, said shaft being driven by an electromotor 28 via a transmission belt 29. The sense of rotation of the brushes is the same as the transport rolls and the wax roll, in the present case clockwise, whilst the rotational speed is higher than of the rolls. Being springily mounted, the top surface of the brushes is slightly above the level of the rolls. The brushes can be those utilized for polishing metal parts.

Each bearing of shaft 27 is mounted in a pivoted lever 30, which is attached at pivot 31. The lever 30 is held about in its middle by a tension spring 32, which is released in the stationary position of the lever, and the brushes are forced down against the tension of spring 32 if loaded by the skis passing on it. At the other end the spring 32 is attached to an adjustable support 33 with adjusting screw 34, for compensating the use of the brushes. In this embodiment, only one of the two pivoted levers is provided with a tension spring, but it is of course possible to provide both levers with less stronger springs.

Seven of the eight transport rolls 2 and 2''', and wax roll 8 are driven by a driver unit 35 with electromotor 36 and an endless chain drive with chain 37 acting on chain wheels 38 at each of the seven transport rolls and the wax roll. The last roll 39 is not driven and rolls loosely. It follows from FIG. 2 that below each chain wheel, in offset position, is arranged a deflection pulley 40, whereby one or more of those pulleys is hingedly fixed for providing tension on the chain. The driving force of electromotor 36 is transmitted via a transmission belt 41 on the chain driving, toothed wheel 42. in the present embodiment the electromotor 36 for the chain drive is arranged at the outgoing end of the apparatus and the not engaged part of the chain between the motor and the first deflection pulley 40' passes near the bottom 43 of the body 1.

Figure 3:
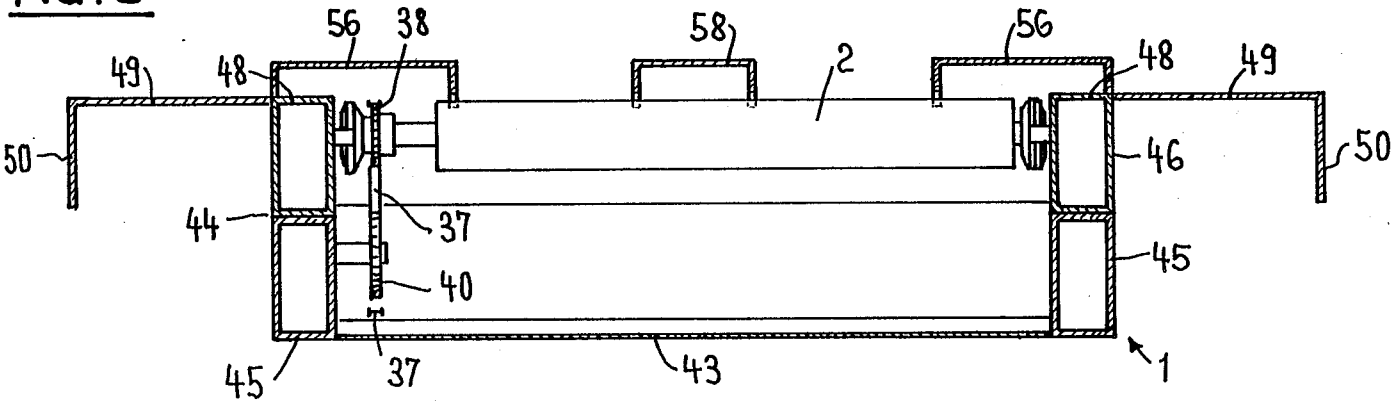
FIG. 3 is a sectional view of the apparatus of FIG. 1 taken along line III—III in FIG. 1.
Figure 6:
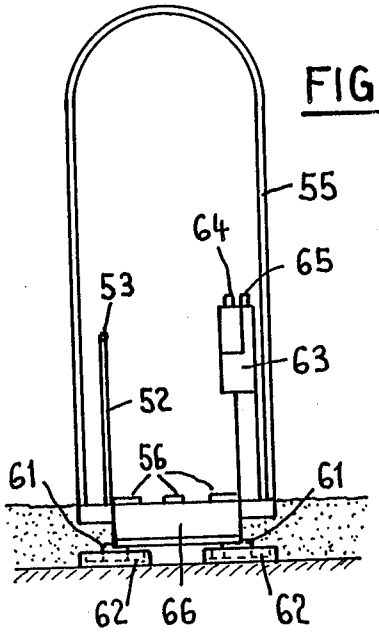
FIG. 6 is a front elevational view of a second embodiment of the apparatus of the present invention.

The body 1 of the apparatus is as closed as possible, with the exception of the upper parts of the rolls. The bottom 43 of the body is continuous and preferably insulated, at least in the vicinity of the wax container. The longitudinal walls 44, see FIGS. 3 and 4, consist each of two superimposed box girders 45 and 46, and are closed by two end plates 66 to form a box-shaped body. The bottom 47 of the underlying box girders 45 are connected to the bottom 43 of the body. The top surface 48 of the overlying box girders 46 extends outwardly to form a platform 49 with a downward direction leg 50. At the outside 51 of the top box girders 46 and reaching through the platform are fastened posts 52 for receiving a handhold 53, shown in FIG. 6. This handhold can be on one side or preferably, to give more security, on both sides. The box girder construction of the longitudinal wall of the body causes a high torsional stability, which is necessary to assure an even and precise layer of wax. The platforms 49 comprise further means 54 for fastening a tunnel-like cover 55, as shown in FIG. 6. This cover can be made of transparent plastic material, which must be wind and cold resistent as well as impervious to sunshine and ultraviolet rays. There are further several supports and diagonal members not shown for clarity sake, connected to the box girders and the platforms.

On the surface of the body are arranged two lateral guide plates 56, in the form of an upside down U, which have the function to guide the skis and to cover in particular the chain drive and chain wheels. The lateral guide plates can be fastened by screws. In the preferred embodiment, the guide plates are hingedly mounted on perpendicular hinges 57, so that always two lateral guides have a common hinge. In the middle, there is a central guide plate 58, also in the form of an upside down U, removeably fixed to the not shown support and diagonal member structure. At the entry, the inner surfaces 59 and 60 of the lateral, central guide plates are bevelled for facilitating entry of the skis.

Between the guide plates and the rolls cover plates 61 are arranged so as to cover as much as possible those rolls. The cover plates are fixed to the structure in a manner not shown.

To facilitate handling of the apparatus, in particular in snow, the underside of the bottom 43 of the body is provided with longitudinal beams 61, under which skids 62 are mounted, as shown schematically in FIG. 6. Some or all skids or skid-supports, can be equiped with means for regulating the level of the apparatus.

The apparatus is controlled by an electric installation comprising a switch board 63 with control lamps 64 and 65. The switch board controls the heating unit of the way container for heating and temperature controlling the wax in the wax container and the two electromotors for the transport and wax rolls and the polishing brushes. The switch board further comprises a timer for allowing the wax to melt before the wax roll is set in motion. Usually this time delay will be 30 minutes. Then the red light 64 switches to green light 65, and it is possible to use the apparatus. The motor for driving the rolls could also be controlled by a temperature sensor for the wax in the wax container, releasing the motor only after a predetermined temperature has been reached. Even if the motor would be started too early, it would not result in much damage since the chain passes evenly on and wheel 38' the chain would come off if the wax roll 8 is immobilized by the solid wax. The switch board, and accordingly the apparatus, is operated by a coin collector, which sets the apparatus in motion if the green light is on. The duration of the whole operation can be adjusted according to ambient temperature, or other parameters. Usually the duration of the operation is 60 to 90 seconds.

The apparatus has high operational reliability even in cold weather and produces a good finish on the waxed skis.

I claim:

1. An automated ski waxing apparatus, where the skiing person glides through the apparatus with his skis on, comprising:

a housing having an entry end and an exit end;

a plurality of transport rolls rotatably mounted to said housing for transporting a pair of skis along a path from said entry end to said exit end;

a first heating means mounted within said housing proximate to said entry end comprising a warm air unit for drying and pre-heating the skis;

a wax container for containing a pool of molten wax located within said housing;

a wax roll rotatably mounted for rotating at least partially within said wax container in contact with said molten wax, located to contact the skis at a point along said path subsequent to said first heating means;

a second heating means adjacent said wax container for providing heat to said molten wax;

an insulating layer surrounding those portions of said second heating means not adjacent to said wax container; and scraping means located at a point along said path subsequent to said wax roll having a scraping knife movably biased towards said skis.

2. The waxing apparatus of claim 1, wherein said wax roll is mounted with respect to said wax containers such that at least 50 percent of the surface area of said wax roll is below the surface of said molten wax pool.

3. The waxing apparatus of claim 2, wherein said wax roll is mounted with respect to said wax containers such that between about 80 percent to about 90 percent of the surface area of said wax roll is below the surface of said molten wax pool.

4. The waxing apparatus of claim 2, further comprising:

a brushing unit having a brush movably biased towards operative engagement with said axis, wherein said brush is positioned proximate said exit end, for operative engagement with said skis at a point along said path subsequent to said scraping means.

5. The waxing apparatus of claim 1 or 4, wherein said warm air unit comprises four warm air blowers each having a nozzle.

6. The waxing apparatus of claim 1 or 4, wherein said scraping unit comprises a wax waste container arranged between the wax container and the knives, a part of the wall looking toward the knives being louvred to reach behind said knives.

7. The waxing apparatus of claim 1 or 4, wherein said waxing apparatus is enclosed in a transportable box-shaped body, said body having a continuous bottom, longitudinal walls made of box girders, and being closed at both ends by end plates; the top of the body comprising two lateral ski guide plates and central ski guide plates.

8. The waxing apparatus of claim 7, wherein the top surface of said longitudinal walls extends outwardly into a platform, the outer face of the walls and said platform being provided with means for fixing posts for sustaining a handhold and for fixing a tunnel-like cover, made of transparent plastics material.

9. The waxing apparatus of claim 7, wherein the bottom of said body is provided with skids, wherein said skids or their mounting have means for adjusting the level of said waxing apparatus.

* * * * *